United States Patent [19]

Röhling et al.

[11] Patent Number: 4,836,197

[45] Date of Patent: Jun. 6, 1989

[54] FOLDED PROTECTIVE HOOD HAVING AN OXYGEN MASK

[75] Inventors: Holmer Röhling, Reinfeld; Frank Schulz, Lübeck; Wolfgang Marqardt, Lübeck, all of Fed. Rep. of Germany

[73] Assignee: Drägerwerk Aktiengesellschaft, Lübeck, Fed. Rep. of Germany

[21] Appl. No.: 205,074

[22] Filed: Jun. 10, 1988

[30] Foreign Application Priority Data

Jun. 11, 1987 [DE] Fed. Rep. of Germany ..... 3719426

[51] Int. Cl.[4] ..... A62B 17/04; A62B 18/02

[52] U.S. Cl. ..... 128/201.23; 128/204.18

[58] Field of Search ..... 128/201.22, 201.23, 128/204.18, 205.13, 205.17, 205.25, 206.21, 206.23, 206.27, 206.28, 202.13

[56] References Cited

U.S. PATENT DOCUMENTS

| | | | |
|---|---|---|---|
| 4,473,072 | 9/1984 | Walther | 128/202.13 |
| 4,523,588 | 6/1985 | Dolsky | 128/202.18 |
| 4,559,939 | 12/1985 | Levine et al. | 128/201.28 |
| 4,766,893 | 8/1988 | Drews | 128/204.18 |

*Primary Examiner*—Edgar S. Burr
*Assistant Examiner*—Kimberly L. Asher
*Attorney, Agent, or Firm*—Walter Ottesen

[57] ABSTRACT

The invention relates to a protective hood having a viewing window and an oxygen mask equipped with a breathing-gas connection for an oxygen supply. The protective hood is improved in that the oxygen supply is first established unhindered and the protective hood can be pulled over the head with a reliable manual movement when required without the oxygen supply having to be interrupted. Such a protective hood is especially useable by passengers in an aircraft. The protective hood is packed such that the hood is rolled up toward the front in four mutually perpendicular directions in the direction of the breathing-gas connection for the oxygen mask so that a rip loop holds the rolled parts together by means of a VELCRO closure. The rip loop is attached to the hood in the region thereof corresponding to the nape of the neck. For the required situation and while the user holds the oxygen mask in place on the face, the user need only pull on the loop thereby causing the rolled hood to unfold and the edge of the hood can be simply pulled over the head.

3 Claims, 2 Drawing Sheets

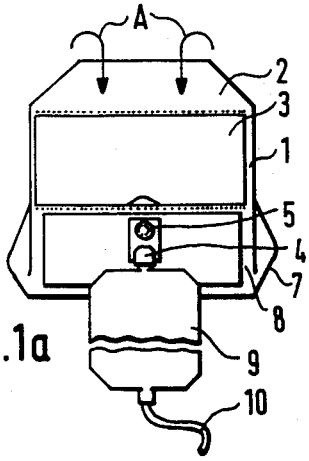
Fig.1a
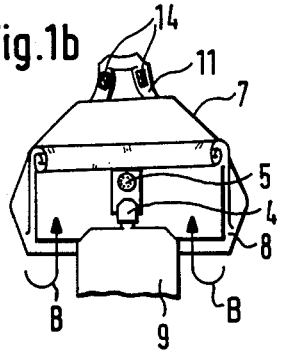
Fig.1b
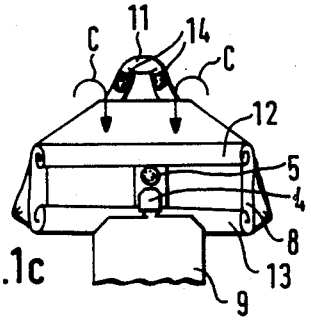
Fig.1c
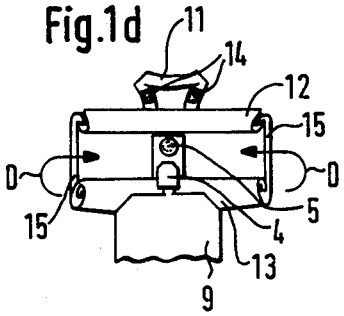
Fig.1d
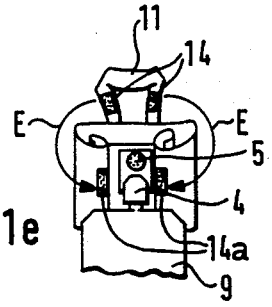
Fig.1e
Fig.1f
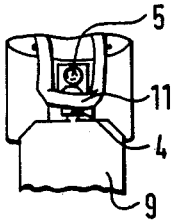

FOLDED PROTECTIVE HOOD HAVING AN OXYGEN MASK

FIELD OF THE INVENTION

The invention relates to a folded protective hood having a viewing window and an oxygen mask equipped with a breathing gas connector for connection to an oxygen supply.

BACKGROUND OF THE INVENTION

Protective hoods of this kind are used, for example, for passengers in an aircraft in order to provide them with a suitable protection against the development of smoke in the case of an emergency and to make possible a needed supply of oxygen in the event of decompression. A combined protective hood of this kind is disclosed in U.S. Pat. No. 4,559,939.

The handling of such a combined protective hood is, however, complex in that first the protective hood must be pulled over the head before the breathing connection to the oxygen supply can be established. This handling operation unnecessarily increases the time until the oxygen supply actually becomes available to the passenger in the event of a decompression situation.

In decompression situations, it is first most important that the required oxygen supply is established. This can be achieved with the known protective hoods in that first only the mask is pressed against the face. If an annoying or dangerous development of smoke occurs during the emergency which requires putting on a smoke-protective hood, then the previously applied oxygen mask must be removed and the protective hood must be pulled over the head and the breathing-gas supply reestablished by placing the oxygen mask onto a corresponding connection provided on the protective hood. The passenger is decoupled from the oxygen supply while carrying out this manipulation and must unfold the hood with difficulty and pull the same over the head. However, in an emergency, the passenger does not have adequate time and cannot use the requisite care so that improper handling and an incorrect seating of the hood results.

SUMMARY OF THE INVENTION

It is an object of the invention to provide a protective hood of the kind described above which is so improved that the oxygen supply can first be established unhindered and so that the protective hood can pulled over the head with a safe manual handling in a required situation without having to interrupt the oxygen supply.

The folded protective hood of the invention is to be worn on the head and over the neck of a wearer. The protective hood includes: a head portion extending downwardly to a neck region and then terminating in a lower edge defining a hood opening; the head portion and the neck region conjointly defining a forward portion and a rearward portion with the lower part of the rearward portion being a nape region corresponding to the nape of the neck of the wearer; a viewing window mounted in the head portion of the forward portion; an oxygen mask mounted in the forward portion directly beneath the viewing window and including a breathing gas connector for connecting the mask to a supply of breathing gas; the hood having an inner wall surface disposed in surrounding relationship to the breathing gas connector and the breathing mask; first holding means formed on the inner wall surface adjacent the connector; second holding means formed on the nape region; the head portion starting at the nape region being rolled up toward the connector to define a first roll, the neck region at the forward portion being rolled up toward the connector to define a second roll; the first and second rolls each having respective ends folded in toward the connector so as to expose the first holding means; and, the second holding means being folded over to engage the first holding means thereby holding the protective hood as a folded package with said breathing mask being accessible to the wearer while the hood is in the folded condition.

The advantage of the invention is seen essentially in that the inner surface of the oxygen mask faces the passenger when the protective hood is in its folded condition so that the passenger can immediately apply the mask in the event of a decompression situation and be supplied with oxygen. If it is necessary during this time to pull the protective hood over the head, the passenger must only pull with the one hand on the holding edge so that the outwardly folded inner surface of the protective hood unfolds automatically as a consequence of the pull action and can, with one pulling tug, he pulled over the head all the way down to the neck and be reliably seated. During this time, the oxygen mask can be pressed with the other hand continuously on the mouth and nose region since the protective hood can be pulled over the head with only one hand.

The folded protective hood requires only a little more space than the oxygen mask itself and does not hinder the manipulation of the oxygen mask during breathing in the case of a decompression. The hood when packed is small and therefore requires little storage space.

It has been shown especially advantageous to configure the holding elements as well as the grasping edge in the form of VELCRO closures which self-open when pulling the head hood over the head and which release the rolled ends of the protective hood.

The gripping edge is advantageously configured as a holding loop. However, the gripping edge can also be configured as a pass-through opening at the edge of the hood opening in the region of the nape of the neck.

BRIEF DESCRIPTION OF THE DRAWINGS

The invention will now be explained with reference to the drawings wherein:

FIGS. 1*a* to 1*f* show the protective hood according to the invention in various stages of folding up to the completely packed unit; and, FIG. 2 is a front elevation view of the folded protective hood seen from the mask side thereof.

DESCRIPTION OF THE PREFERRED EMBODIMENTS OF THE INVENTION

Figure 2:
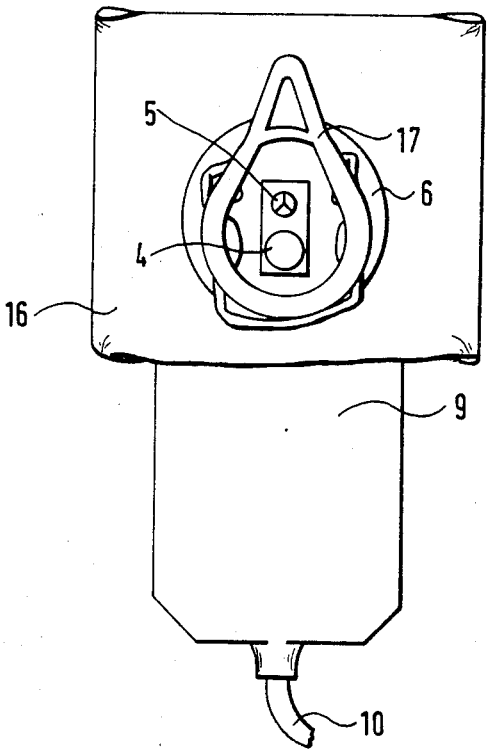

The protective hood 1 illustrated in FIG. 1*a* is shown in its spread-out condition. The head region 2 is shown with a viewing window 3 beneath which a breathing-gas connection 4 and an exhale valve 5 are provided for the oxygen mask lying therebehind. The hood edge 7 defines the end of the neck region 8 of the hood 1 with the neck region 8 being disposed beneath the viewing window 3. A breathing bag 9 is attached to the breathing gas connection 4 and is connectable via a hose line 10 with an oxygen source not shown.

The hood 1 shown in FIG. 1*a* is first rolled up from the rear toward the front in the direction of arrows A until the grip edge provided on the rearward portion of the hood edge 7 appears as shown in FIG. 1*b*. The grip edge can be in the form of a loop 11 as also shown in FIG. 1*b*.

Thereafter, the forward portion of hood edge 7 is likewise rolled up from rear to front in the direction of movement of the arrows B and toward the connection 4. The upper roll 12 and the lower roll 13 shown in FIG. 1*c* lie at respective sides of connector 4 and of the exhale valve 5 when viewed in vertical direction.

The loop 11 is folded over toward the connector 4 in the direction of arrows C and the two connecting sides 15 between the ends of both rolls (12, 13) are likewise folded over toward the connector 4 in the direction of arrows D as shown in FIG. 1*d*.

As shown in FIG. 1*e*, holding elements 14*a* provided on the inner side then become visible and are in the form of VELCRO bands. These VELCRO bands can be attached to corresponding VELCRO bands 14 of the upwardly folded loop 11 when the latter is pulled down as indicated by directional arrows E.

The completely folded protective hood shown in FIG. 1*f* is thereby rolled together from all four directions toward connector 4 and the exhale valve 5 and is held together by means of the loop 11.

FIG. 2 shows the rearward side of the protective hood and the non-folded portion of the inner wall 16 thereof. The non-folded portion includes the exposed subregion around the oxygen mask 6, the sealing edge 17, the inlet openings of the breathing gas connection 4 and the exhale valve 5 facing toward the user.

It is understood that the foregoing description is that of the preferred embodiments of the invention and that various changes and modifications may be made thereto without departing from the spirit and scope of the invention as defined in the appended claims.

What is claimed is:

1. A folded protective hood to be worn on the head and over the neck of a wearer, the protective hood comprising:

a head portion extending downwardly to a neck region and then terminating in a lower edge defining a hood opening;

said head portion and said neck region conjointly defining a forward portion and a rearward portion with the lower part of said rearward portion being a nape region corresponding to the nape of the neck of the wearer;

a viewing window mounted in said head portion of said forward portion;

an oxygen mask mounted in said forward portion directly beneath said viewing window and including a breathing gas connector for connecting the mask to a supply of breathing gas;

said hood having an inner wall surface disposed in surrounding relationship to said breathing gas connector and said breathing mask;

first holding means formed on said inner wall surface adjacent said connector;

second holding means formed on said nape region;

said head portion starting at said nape region being rolled up toward said connector to define a first roll;

said neck region at said forward portion being rolled up toward said connector to define a second roll;

said first and second rolls each having respective ends folded in toward said connector so as to expose said first holding means; and, said second holding means being folded over to engage said first holding means thereby holding said protective hood as a folded package with said breathing mask being accessible to the wearer while said hood is in the folded condition.

2. The folded protective hood of claim 1, said first holding means comprising a set of VELCRO holding elements mounted on said inner wall surface; and, said second holding means comprising a gripping edge formed in said nape region and having a VELCRO element mounted thereon for engaging said VELCRO holding elements on said inner wall surface.

3. The folded protective hood of claim 2, said gripping edge being a loop formed on said lower edge defining said hood opening.

* * * * *

UNITED STATES PATENT AND TRADEMARK OFFICE

CERTIFICATE OF CORRECTION

PATENT NO. : 4,836,197

DATED : June 6, 1989

INVENTOR(S) : Holmer Röhling, Frank Schulz and Wolfgang Marquardt

It is certified that error appears in the above-identified patent and that said Letters Patent is hereby corrected as shown below:

In column 1, line 49: insert -- be -- between "can" and "pulled".

In column 2, line 24: delete "he" and substitute -- be -- therefor.

Signed and Sealed this

Twentieth Day of March, 1990

*Attest:*

JEFFREY M. SAMUELS

*Attesting Officer*

*Acting Commissioner of Patents and Trademarks*